US005681085A

United States Patent [19]

Nahoul

[11] Patent Number: 5,681,085

[45] Date of Patent: Oct. 28, 1997

[54] ROCKING ARMCHAIR WITH RECLINING SEAT AND BACK

[75] Inventor: José Letayf Nahoul, Naucalpan, Mexico

[73] Assignee: Industrias Ideal, S.A. de C.V., Naucalpan, Mexico

[21] Appl. No.: 666,598

[22] Filed: Jun. 18, 1996

[51] Int. Cl.[6] ..... A47C 3/00

[52] U.S. Cl. ..... 297/302.4; 297/302.1; 297/326; 297/354.1

[58] Field of Search ..... 297/258.1, 301.1, 297/301.4, 302.1, 302.4, 285, 261.1, 261.2, 354.1, 354.12, 411.45, 411.44, 326, 327

[56] References Cited

U.S. PATENT DOCUMENTS

| | | | |
|---|---|---|---|
| 2,595,582 | 5/1952 | Hoven et al. | 297/302.4 |
| 3,342,527 | 9/1967 | Bencene | 297/354.12 |
| 5,174,630 | 12/1992 | Cilliere et al. | 297/301.4 |
| 5,294,178 | 3/1994 | Bögle et al. | 297/302.4 |

FOREIGN PATENT DOCUMENTS

| | | | |
|---|---|---|---|
| 0664032 | 5/1963 | Canada | 297/354.1 |

*Primary Examiner*—Peter M. Cuomo
*Assistant Examiner*—Anthony D. Barfield
*Attorney, Agent, or Firm*—Harrison & Egbert

[57] ABSTRACT

A armchair which is formed by a reclining seat and back and supported by a rectangular shaped structure. The rectangularly shaped structure has lower legs placed on the ground from which the seat and back of the armchair extend upwardly. A pair of arcuate slots are formed on an interior of the structure. An articulating arm has a first bolt at an upper end and a second bolt at a location below the first bolt. The pair of arcuate slots receive the first and second bolts therein. The articulating arm is a flat L-shaped plate. A spring is affixed at one end to an fastener on the articulating arm and at another end to the structure. The spring serves to resiliently support the back in a desired position. A linking arm is affixed to a distal end of the articulating arm from the first and second bolts. The linking arm serves to connect the articulating arm to the seat.

5 Claims, 3 Drawing Sheets

FIG. 2
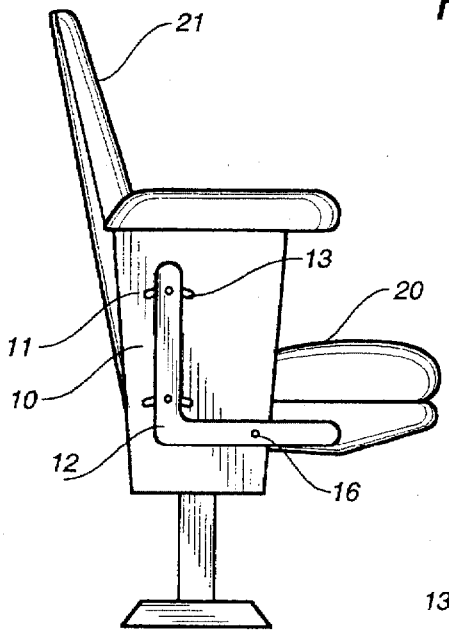
FIG. 4
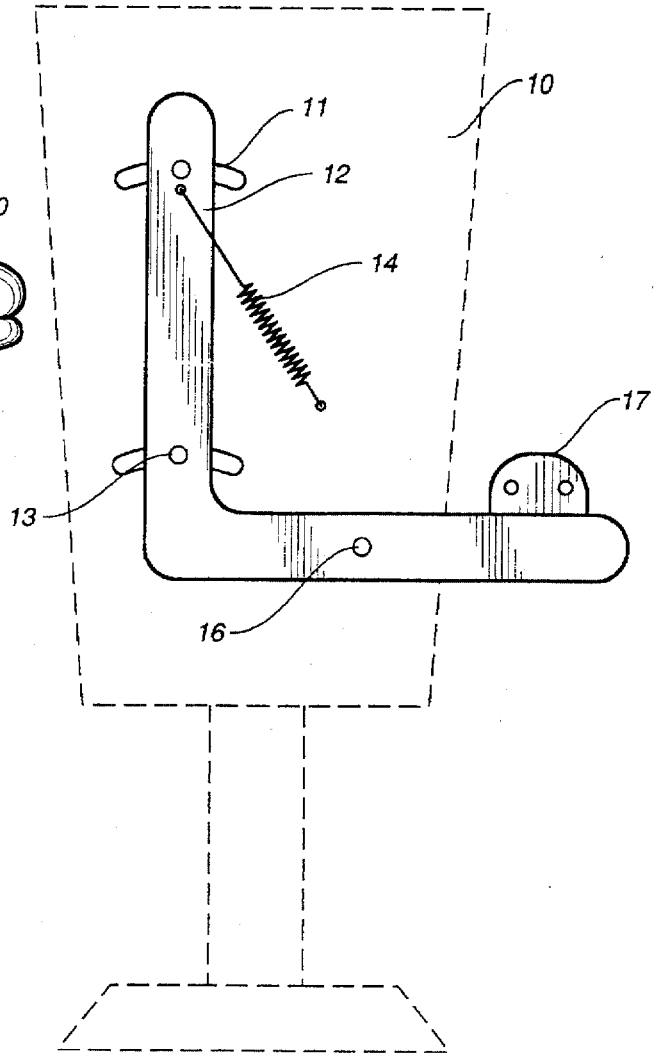
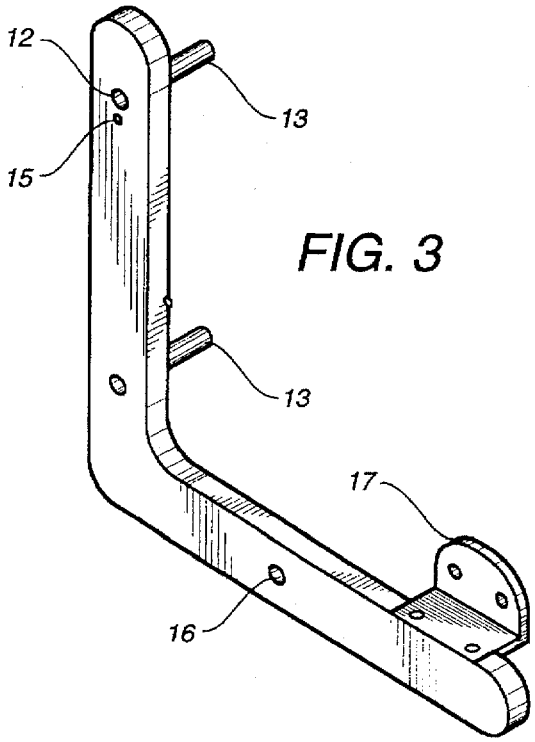
FIG. 3

ROCKING ARMCHAIR WITH RECLINING SEAT AND BACK

FIELD OF INVENTION

The present invention has its field of action within the environment of furnitures and accessories, and particularly refers to reclining chairs and armchairs.

OBJECTIVES OF INVENTION

It is an object of the present invention to create a comfortable armchair, in such a manner that it allows the user to see and enjoy a movie or performance comfortably.

It is another purpose of the invention to provide reclination possibilities both for the seat and back and also a rocking chair with a simple operation and without so many components.

It is an aim of present invention to provide a reclining armchair, operable by the user, allowing for people to pass in front of the same without the need for the user to stand up.

These and other objects and advantages of the present invention will become apparent from a reading of the attached specification and appended claims.

BACKGROUND OF INVENTION

It is known that armchairs installed in most theaters for different purposes, comprise a movable seat with a fixed back.

It is desirable to modify this feature, since in practice this results tiring to the user, apart from the fact that many people of coming late to the show, to reach their seats have to cross sections where other people are seated who have to stand up to let them pass, which of course is cumbersome for both.

Although some models are known of armchairs having a reclining seat, based on springs that join the seat to the back, said inventions do not satisfy the expectations, due to the fragility of the springs, which can fail. Placing other—stronger —springs, make the seat and back become too stiff and consequently, makes it impossible to recline them.

On the other hand, an armchair is not yet known that possesses an automatic and anatomically adapted mechanism which allows a rocking at the moment a person sits down.

The invention here proposed, substitutes the above drawbacks, in a more simple and easy manner, through a lever arm, which attaches the back to the seat, with springs in order to assist in the reclining movement of the back and seat While at the same time eases the pressure exerted on the seat and back.

BRIEF DESCRIPTION OF THE INVENTION

The features of this armchair with reclining seat and back will be explained in the following description and shown in the accompanying drawings, as an illustration thereof, being the same reference signs used to indicate similar parts in the drawings shown.

FIG. 2 is a view of the mechanism of a articulated arm that joins the back to the seat;

FIG. 3 is conventional perspective view of the arm and the mechanism for moving the back and seat;

FIG. 4 is another vertical view of the mechanism for the back of the armchair, each side;

DETAILED DESCRIPTION OF THE INVENTION

Figure 1:
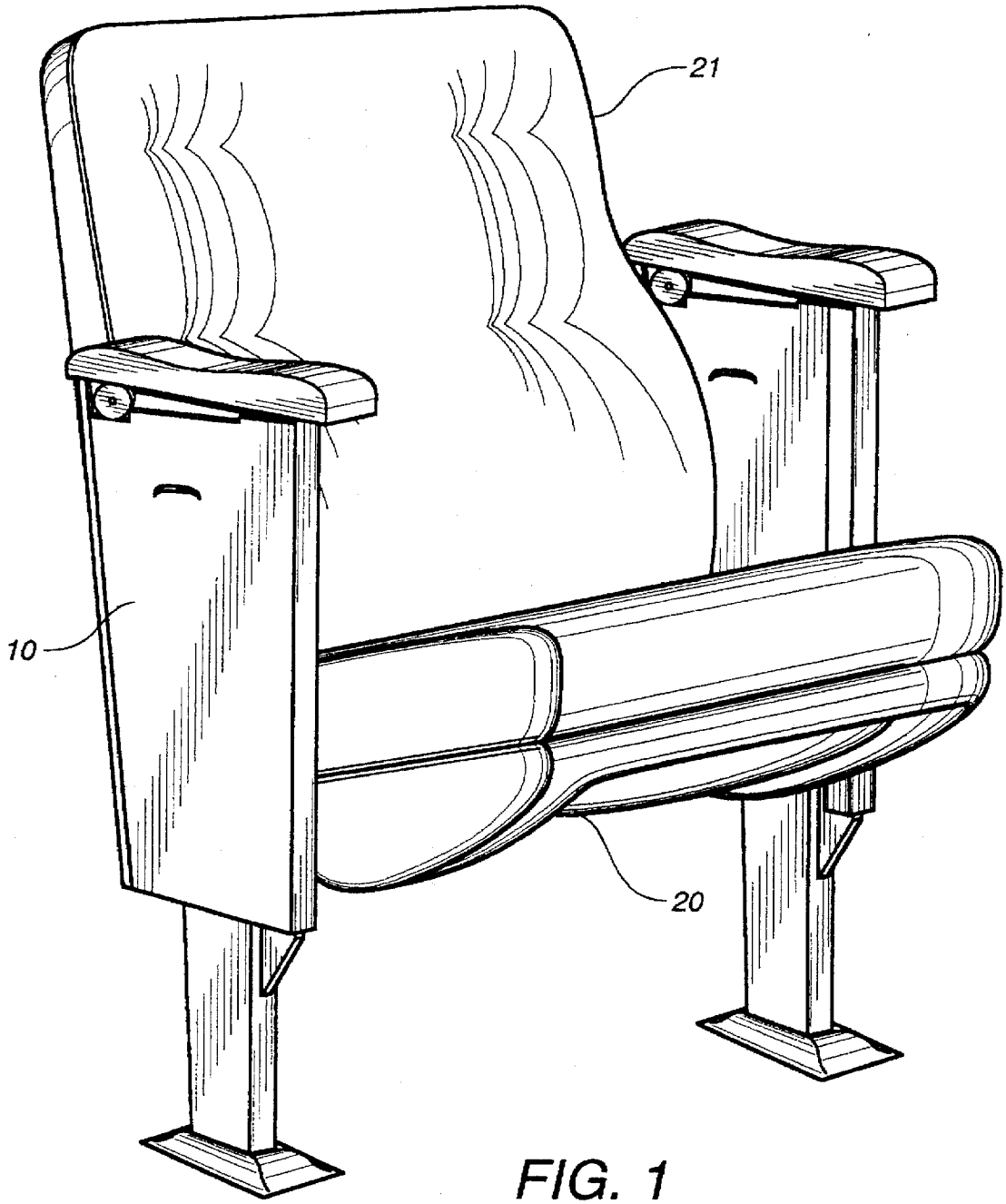
FIG. 1 PRIOR ART
FIG. 1 is a conventional perspective view of a prior art rocking arm chair model which is very common in theatres.
Figure 5:
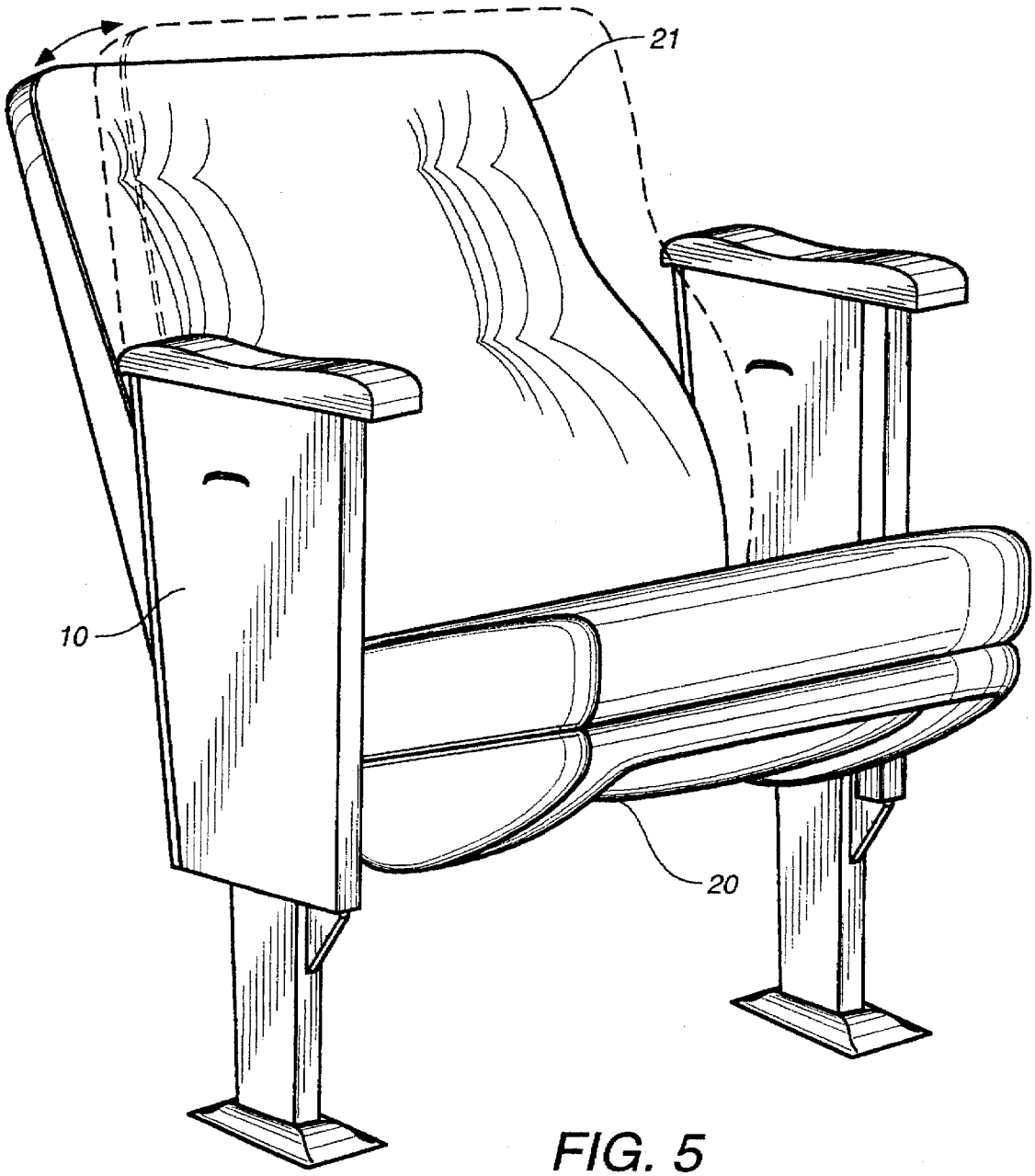
FIG. 5 is a conventional perspective of an armchair, showing the back and seat reclined, in a resting position.

With reference to the drawings, the invention is constituted by a structure (10) of rectangular shape, with its lower legs standing on the ground, and from which the seat (20) and back (21) extend upwards. Its combination forms the armchair itself, with arcuate slots (11) extending inward, and an articulated arm.(12) placed over the slots, so as to make it possible to impart a certain mobility to the seat (20) and back (21).

The articulated arm (12) is formed by a L-shaped flat plate, that carries bolts (13), both in its upper end as well as its middle part, which overlap the articulated arm (12) and match with the eyelets (11). In this manner, the seat (20) and the back (21) will return to their original position, after the disappearance of the driving force.

The lower part of the articulated arm (12), which will be fixed to the seat, has an orifice (16) through which a conventional bolt is inserted; this said bolt operates as a supporting point from the articulated arm (12).

A spring 14 is (14), placed at the sides of the structure in a conventional armchair. The spring 14 has sufficient spirals to absorb the tensioning efforts derived from the user's weight. The spring 14 has one of the ends attached to the structure 10 and the other end is fixed to an fastener (15) located in the articulated arm (12). In this way, the seat (20) and the back (21) can be reclined.

Finally, a linking arm 17 is formed of a bent plate of rectangular shape, with rounded therefore ends the linking arms is joined to part of the seat (20) whereas at the another end, it is joined to the articulated arm (12).

Regarding its use, is it simply sufficient to lean the user's body against back (21) of the chair and push oneself slightly backward. At that moment, the seat (20) and the back (21) will sufficiently recline to allow a person to pass or create a more comfortable resting position for the user. At the moment the load disappears on the back (21), the armchair will return to its original position.

If additionally, the occupying person pushes himself both backward and forward, he will feel the armchair moving periodically, i.e., like a rocking chair, which guarantees an additional rest.

I claim:

1. A rocking armchair with reclining seat and back which is supported by a rectangular shaped structure, said structure having lower legs placed on the ground, comprising:

a first arcuate slot and a second arcuate formed on an interior of the structure;

an articulating arm having a first bolt at an upper end and a second bolt at a location below said first bolt, said first arcuate slot receiving said first bolt therein, said second arcuate slot receiving said second bolt therein, said articulating arm being a flat L-shaped plate, said first bolt and said second bolt being affixed to the back of the armchair;

a spring means affixed at one end to a fastener on said articulating arm and at another end to said structure, said spring means for resiliently supporting the back in a desired position relative to the structures;

a linking arm affixed to a distal end of said articulating arm from said first and second bolts, said linking arm being affixed to the seat, said linking arm being a bent rectangularly shaped plate with one portion joined to the seat and another portion joined to the articulating arm; and a pivot means connected to the structure and to the seat, said pivot means for allowing said articulating arm to be movable relative to the structure.

2. The rocking armchair of claim 1, said first bolt being movable throughout an entire length of said first slot, said second bolt being movable throughout an entire length of said second slot.

3. The rocking armchair of claim 1, said articulating arm having an orifice formed at a lower part thereof, said pivot means comprising:

a pin extending through said orifice and affixed to said seat, said pin being rotatable in said orifice so as to allow for a rocking movement of the seat and back.

4. The rocking armchair of claim 1, said spring means for absorbing the tensioning caused from a user's weight at the moment of reclining, and at the same time causing a return of the seat and back to an original position.

5. The rocking armchair of claim 1, said spring means for reclining the armchair in a backward and a forward direction.

* * * * *